US009971258B2

(12) United States Patent
Kitamura et al.

(10) Patent No.: US 9,971,258 B2
(45) Date of Patent: May 15, 2018

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Wataru Kitamura, Abiko (JP); Kenichi Ikari, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/506,319

(22) PCT Filed: Sep. 30, 2015

(86) PCT No.: PCT/JP2015/078418
§ 371 (c)(1),
(2) Date: Feb. 24, 2017

(87) PCT Pub. No.: WO2016/052755
PCT Pub. Date: Apr. 7, 2016

(65) Prior Publication Data

US 2017/0285497 A1 Oct. 5, 2017

(30) Foreign Application Priority Data

Sep. 30, 2014 (JP) ..... 2014-202265

(51) Int. Cl.
*G03G 5/047* (2006.01)
*G03G 5/147* (2006.01)
(Continued)

(52) U.S. Cl.
CPC ..... *G03G 5/047* (2013.01); *G03G 5/147* (2013.01); *G03G 15/75* (2013.01); *G03G 15/751* (2013.01);
(Continued)

(58) Field of Classification Search
CPC ..... G03G 5/047; G03G 5/147; G03G 5/07; G03G 15/75; G03G 15/751; G03G 15/754; G03G 21/1814
See application file for complete search history.

(56) References Cited

U.S. PATENT DOCUMENTS 5,876,890 A 3/1999 Kitamura et al.
5,912,098 A 6/1999 Tanaka et al.
(Continued)

FOREIGN PATENT DOCUMENTS

JP 2010-008898 1/2010
JP 2010-160475 7/2010
(Continued)

OTHER PUBLICATIONS

U.S. Appl. No. 15/265,995, Mai Murakami, filed Sep. 15, 2016.
U.S. Appl. No. 15/315,869, Koji Takahashi, filed Dec. 2, 2016.
U.S. Appl. No. 15/413,758, Wataru Kitamura, filed Jan. 24, 2017.

*Primary Examiner* — Joseph S Wong
(74) *Attorney, Agent, or Firm* — Fitzpatrick Cella Harper and Scinto

(57) ABSTRACT

In an electrophotographic photosensitive member, a circumferential surface has concave portions that are independent one another; each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, when viewing each of the concave portions in the axial direction, each of the concave portions has a depth that decreases from a deepest point of each of the concave portions toward the apex.

20 Claims, 7 Drawing Sheets

(51) Int. Cl.
*G03G 5/07* (2006.01)
*G03G 15/00* (2006.01)
*G03G 21/18* (2006.01)

(52) U.S. Cl.
CPC ..... *G03G 15/754* (2013.01); *G03G 21/1814* (2013.01); *G03G 5/07* (2013.01)

(56) References Cited

U.S. PATENT DOCUMENTS

| | | | | |
|---|---|---|---|---|
| 6,405,005 | B1 | 6/2002 | Kitamura et al. | |
| 7,645,547 | B2 | 1/2010 | Okuda et al. | |
| 7,655,370 | B2 | 2/2010 | Kitamura et al. | |
| 7,813,675 | B2 | 10/2010 | Tanabe et al. | |
| 8,886,092 | B2 | 11/2014 | Saito et al. | |
| 2008/0124126 | A1* | 5/2008 | Anezaki | G03G 5/00 399/159 |
| 2011/0243603 | A1* | 10/2011 | Saito | G03G 5/047 399/111 |
| 2014/0004450 | A1 | 1/2014 | Tokimitsu et al. | |
| 2016/0327876 | A1 | 11/2016 | Miyauchi et al. | |

FOREIGN PATENT DOCUMENTS

| | | |
|---|---|---|
| JP | 6127991 | 1/2013 |
| WO | 2009/014262 | 1/2009 |

* cited by examiner (7-3)

(7-4)

(7-5)

(7-6)

ELECTROPHOTOGRAPHIC PHOTOSENSITIVE MEMBER, PROCESS CARTRIDGE AND ELECTROPHOTOGRAPHIC APPARATUS

TECHNICAL FIELD

The present invention relates to an electrophotographic photosensitive member, a process cartridge and an electrophotographic apparatus.

BACKGROUND ART

As an electrophotographic photosensitive member to be rotatably driven in an electrophotographic apparatus, a cylindrical electrophotographic photosensitive member is typically used. Electrical and mechanical external forces such as charging and cleaning are applied to the surface (circumferential surface) of an electrophotographic photosensitive member. Thus, durability to these external forces (such as resistance to wear) is demanded for the electrophotographic photosensitive member.

To meet the demand, techniques for improvement are used in the related art, for example, use of a resin having high resistance to wear (such as curable resins) in the surface layer of the electrophotographic photosensitive member.

On the other hand, examples of problems caused by increasing the resistance to wear of the circumferential surface of the electrophotographic photosensitive member include image deletion and a reduction in cleaning performance.

It is thought that the image deletion is caused by deterioration of a material used for the surface layer of the electrophotographic photosensitive member by ozone and nitrogen oxides produced by charging the circumferential surface of the electrophotographic photosensitive member, or reduction in resistance of the circumferential surface of the electrophotographic photosensitive member due to the adsorption of moisture. As the resistance to wear of the circumferential surface of the electrophotographic photosensitive member is higher, it is more difficult to refresh the circumferential surface of the electrophotographic photosensitive member (remove substances that cause the image deletion such as the deteriorated material and the adsorbed moisture), and the image deletion is more likely to be produced.

As a technique for improving the image deletion, PTL 1 discloses a technique for enhancing dot reproductivity, even if the electrophotographic photosensitive member is left to stand under a high temperature and highly humid environment, by disposing concave portions each having a depth of 0.5 μm or more and 5 μm or less and an opening longest diameter of 20 μm or more and 80 μm or less on the surface (circumferential surface) of an electrophotographic photosensitive member such that an area of the concave portions is 10000 $\mu m^2$ or more and 90000 $\mu m^2$ or less in a square region having a side of 500 μm, and disposing a flat part contained in a portion other than the concave portions such that an area of the flat part is 80000 $\mu m^2$ or more and 240000 $\mu m^2$ or less.

CITATION LIST

Patent Literature

PTL 1: Japanese Patent No. 5127991

SUMMARY OF INVENTION

Technical Problem

Unfortunately, the present inventors, who have conducted extensive research, have found that the technique disclosed in PTL 1 produces stripe-like image defects (hereinafter also referred to as "initial streaks under a high temperature and highly humid environment (H/H initial streaks)") on halftone images if images are output in a low print mode under a high temperature and highly humid environment, and then halftone images having a density of about 30% are output, and that the technique has room for improvement.

The present invention is directed to providing an electrophotographic photosensitive member in which stripe-like image defects generated by image output in a low print mode under a high temperature and highly humid environment are suppressed, and a process cartridge and an electrophotographic apparatus that have the electrophotographic photosensitive member.

Solution to Problem

According to one aspect of the present invention, there is provided a cylindrical electrophotographic photosensitive member to be rotatably driven in an electrophotographic apparatus, wherein, a circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

According to another aspect of the present invention, there is provided a cylindrical electrophotographic photosensitive member, wherein, a circumferential surface of the electrophotographic photosensitive member has concave portions that are independent one another, each of the concave portions has an opening, a contour of the opening has an apex having an angle α of more than 0° and 90° or less on at least one of circumferential directions of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

According to further aspect of the present invention, there is provided a process cartridge to be detachably attached to a main body of an electrophotographic apparatus, wherein, the process cartridge comprises:

a cylindrical electrophotographic photosensitive member to be rotatably driven in the electrophotographic apparatus, and a cleaning blade disposed in contact with a circumferential surface of the electrophotographic photosensitive member, and wherein, the circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex toward the apex, and wherein, when viewing each of the concave portions in the axial direction, each of the concave portions has a depth that decreases from a deepest point of each of the concave portions toward the apex.

According to further aspect of the present invention, there is provided an electrophotographic apparatus comprising:

a cylindrical electrophotographic photosensitive member to be rotatably driven in the electrophotographic apparatus, and a cleaning blade disposed in contact with a circumferential surface of the electrophotographic photosensitive member, wherein, the circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

Advantageous Effects of Invention

According to the present invention, an electrophotographic photosensitive member in which stripe-like image defects generated by image output in a low print mode under a high temperature and highly humid environment are suppressed, and a process cartridge and an electrophotographic apparatus having the electrophotographic photosensitive member can be provided.

Further features of the present invention will become apparent from the following description of exemplary embodiments with reference to the attached drawings.

DESCRIPTION OF EMBODIMENTS

Figure 1:
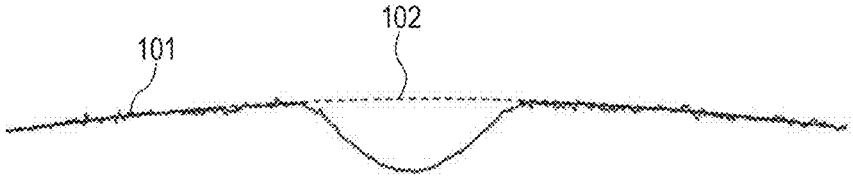
FIG. 1 is a diagram illustrating an example of fitting.

Preferred embodiments of the present invention will now be described in detail in accordance with the accompanying drawings.

The present invention has features different from the techniques disclosed in PTL 1 as follows:

the circumferential surface of the electrophotographic photosensitive member has concave portions that are independent one another, each of the concave portions has an opening, a contour of the opening has an apex having an angle α of more than 0° and 90° or less in at least one direction (at least an upstream side of the rotational direction of the electrophotographic photosensitive member) of the circumferential directions of the electrophotographic photosensitive member, and has a largest width in an axial direction of the electrophotographic photosensitive member of 20 μm or more and 80 μm or less, a width of the contour in the axial direction of the electrophotographic photosensitive member (gradually) decreasing from a portion having the largest width toward the apex, and when viewing each of the concave portions in the axial direction, each of the concave portions has a depth that decreases from the deepest point of each of the concave portions toward the apex.

As a result of research by the present inventors, it was found out that by disposing the specific concave portions as described above on the circumferential surface of the electrophotographic photosensitive member, the effect of suppressing stripe-like image defects generated under a high temperature and highly humid environment is improved. In particular, by disposing in a high density the concave portions each having a specific width on the circumferential surface of the electrophotographic photosensitive member, large distortion in the longitudinal direction of the cleaning blade and vibration (chattering) can be prevented more efficiently. Such concave portions provide more stable friction between the electrophotographic photosensitive member and the cleaning blade even under environments in which the cleaning blade receives a large load. If an apex having an angle α of more than 0° and 90° or less is disposed on the upstream side (backward side) of the rotational direction of the electrophotographic photosensitive member and the width of the contour of the opening of each of the concave portions in the axial direction of the electrophotographic photosensitive member decreases from a portion having the largest width toward the apex, deformation of the cleaning blade and thus the accompanied vibration of the cleaning blade are prevented when the cleaning blade passes on the upstream side (backward side) of the concave portion. As a result, the behavior of the cleaning blade in a micro region is homogenized. The present inventors believe that this leads to a significant improvement in homogenized friction state between the cleaning blade and the electrophotographic photosensitive member to reduce memories generated by objects adhering to the circumferential surface of the electrophotographic photosensitive member and uneven friction, and hence exert the effect of preventing H/H initial streaks.

Specifically, the circumferential surface of the electrophotographic photosensitive member according to the present invention has concave portions that are independent one another, the largest width of a contour of the opening of each of the concave portions in the axial direction of the electrophotographic photosensitive member is 20 μm or more and 80 μm or less, the contour of the opening of each of the concave portions has an apex having an angle α of more than 0° and 90° or less on at least an upstream side of the rotational direction of the electrophotographic photosensitive member, the width of the contour of the opening of each of the concave portions in the axial direction of the electrophotographic photosensitive member decreases from a portion having the largest width toward the apex, and the depth of each of the concave portions decreases from the deepest point of each of the concave portion toward the apex when each of the concave portion is viewed in the axial direction. Such a concave portion is hereinafter also referred to as "specific concave portion".

In the present invention, when a square region having a side of 500 μm (area of 250000 $\mu m^2$) is disposed in any position of the circumferential surface of the electrophotographic photosensitive member (namely, even if a square region having a side of 500 μm is disposed in any position of the circumferential surface of the electrophotographic photosensitive member), the specific concave portion can be provided on the circumferential surface of the electrophotographic photosensitive member such that area of the specific concave portion in the square region having a side of 500 μm is 100000 $\mu m^2$ or more.

Alternatively, in the present invention, when a square region having a side of 500 μm (area of 250000 μm) is disposed in any position of the contact area between the circumferential surface of the electrophotographic photosensitive member and the cleaning blade (namely, even if the square region having a side of 500 μm is disposed in any position of the contact area between the circumferential surface of the electrophotographic photosensitive member and the cleaning blade), the specific concave portion can be provided on the circumferential surface of the electrophotographic photosensitive member such that the area of the specific concave portion in the square region having a side of 500 μm is 100000 $\mu m^2$ or more. The circumferential surface of the cylindrical electrophotographic photosensitive member has a surface curved in the circumferential direction. Thus, "disposing a square region having a side of 500 μm (area of 250000 $\mu m^2$) in any position of the circumferential surface of the electrophotographic photosensitive member" means that when the curved surface is corrected to a plane, a region that is a square in the plane (area of 250000 $\mu m^2$) is disposed in any position of the circumferential surface of the electrophotographic photosensitive member. Similarly, "disposing a square region having a side of 500 μm (area of 250000 $\mu m^2$) in any position of the contact area between the circumferential surface of the electrophotographic photosensitive member and cleaning blade" means that when the curved surface is corrected to a plane, a region that is a square in the plane (area of 250000 $\mu m^2$) is disposed in any position of the contact area between the circumferential surface of the electrophotographic photosensitive member and the cleaning blade.

The specific concave portion on the circumferential surface of the electrophotographic photosensitive member can be observed using a microscope such as a laser microscope, an optical microscope, an electron microscope, and an atomic force microscope.

As the laser microscope, the following can be used, for example:

Ultra-high Depth Shape Measurement Microscope VK-8550,

Ultra-high Depth Shape Measurement Microscope VK-9000,

Ultra-high Depth Shape Measurement Microscopes VK-9500,

VK-X200 and VK-X100 made by Keyence Corporation;

Confocal Scanning Laser Microscope OLS3000 made by Olympus Corporation; and

Real Color Confocal Microscope OPTELICS C130 made by Lasertec Corporation.

As the optical microscope, the following can be used, for example:

Digital Microscope VHX-500, Digital Microscope VHX-200 made by Keyence Corporation; and 3D Digital Microscope VC-7700 made by OMRON Corporation.

As the electron microscope, the following can be used, for example:

3D Real Surface View Microscope VE-9800, 3D Real Surface View Microscope VE-8800 made by Keyence Corporation;

Scanning Electron Microscope Conventional/Variable Pressure SEM made by SII NanoTechnology Inc.; and Scanning Electron Microscope SUPERSCAN SS-550 made by SHIMADZU Corporation.

As the atomic force microscope, the following can be used, for example:

Nanoscale Hybrid Microscope VN-8000 made by Keyence Corporation;

Scanning Probe Microscope NanoNavi Station made by SII NanoTechnology Inc.; and

Scanning Probe Microscope SPM-9600 made by SHIMADZU Corporation.

The 500μm×500 μm square region may be observed at a magnification such that the 500 μm×500 μm square region is included in the field; or the square region may be partially observed at a higher magnification, and a plurality of partial images may be combined using software.

The specific concave portion in the 500 μm×500 μm square region will be described below. First, the surface of the electrophotographic photosensitive member is enlarged and observed by a microscope. Because the circumferential surface of the electrophotographic photosensitive member has a surface curved in the circumferential direction, the cross-sectional profile of the curved surface is extracted, a curve (an arc) is fitted. FIG. 1 illustrates an example of fitting. The example illustrated in FIG. 1 is an example in which the electrophotographic photosensitive member is cylindrical. In FIG. 1, a solid line 101 indicates the cross-sectional profile of the circumferential surface (curved surface) of the electrophotographic photosensitive member, and a dashed line 102 indicates a curve fitted to the cross-sectional profile 101. The cross-sectional profile 101 is corrected such that the curve 102 becomes a straight line, and a surface obtained by extending the obtained straight line in the longitudinal direction of the electrophotographic photosensitive member (in the direction intersecting perpendicular to the circumferential direction) is defined as a reference surface. In the case where the electrophotographic photosensitive member is not cylindrical, the reference surface is obtained in the same manner as in the case where the electrophotographic photosensitive member is cylindrical.

The portion located below from the obtained reference is defined as the concave portions in the square region. The distance from the reference surface to the lowest point of the concave portions is defined as the depth of the concave portion. The cross section of the concave portions taken along the reference surface is defined as the opening. Among line segments intersecting the opening in the axial direction, the length of the longest line segment is defined as the width of the opening of the concave portion. The largest width of the contour of the opening of the specific concave portion in the present invention is preferably within the range of 20 μm or more and 80 μm or less from the viewpoint of stabilizing the cleaning blade and effectively reducing H/H initial streaks. The width of the opening of the specific concave portion is more preferably within the range of 30 μm or more and 60 μm or less. The area of the specific concave portion in the square region is preferably 100000 $\mu m^2$ or more, more preferably 100000 $\mu m^2$ or more and 175000 $\mu m^2$ or less.

The standard deviation of the measured areas of 50 concave portions can be 5% or less in the measurement of the areas of the specific concave portions in the square region having a side of 500 μm disposed in any 50 places on the circumferential surface of the electrophotographic photosensitive member.

Figure 2:
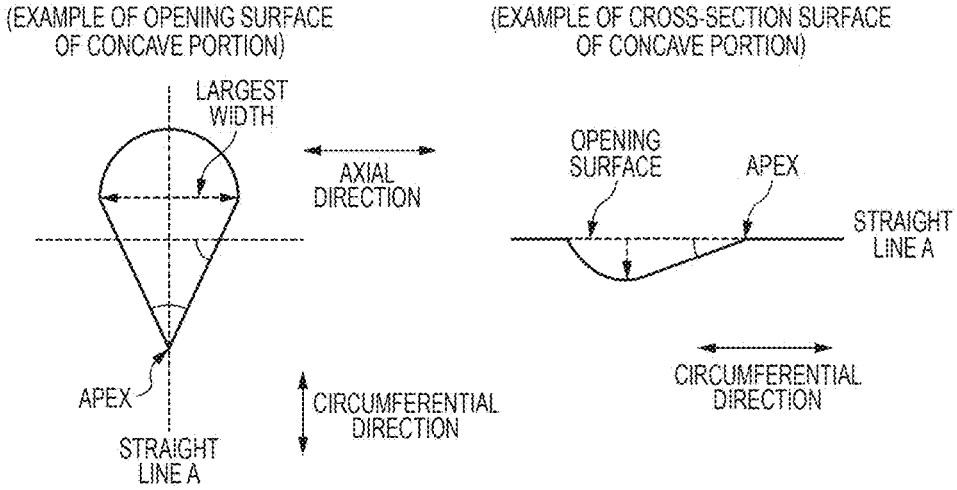
FIG. 2 is a diagram schematically illustrating the relationship of the concave portion in the present application.
Figure 3A:
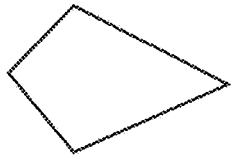
FIGS. 3A, 3B, 3C, 3D, 3E, 3F, 3G, 3H, 3I and 3J are diagrams illustrating examples of a shape of the opening of the concave portion disposed on the circumferential surface of the electrophotographic photosensitive member.
Figure 3B:
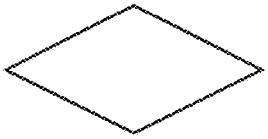
Figure 3C:
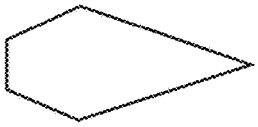
Figure 3D:
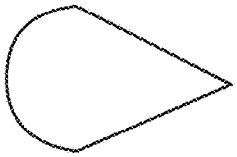
Figure 3E:
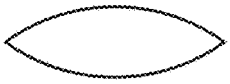
Figure 3F:
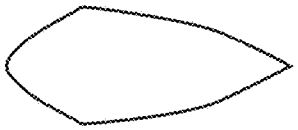
Figure 3G:
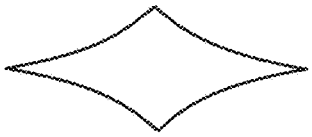
Figure 3H:
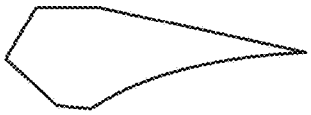
Figure 3I:
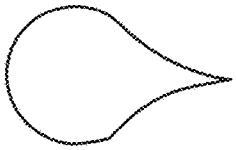
Figure 3J:
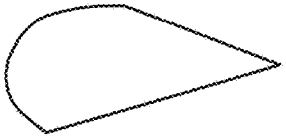
Figure 4A:
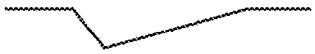
FIGS. 4A, 4B, 4C, 4D, 4E, 4F, 4G and 4H are diagrams illustrating examples of a shape of the cross section surface of the concave portion on the circumferential surface of the electrophotographic photosensitive member, which are viewed from the circumferential direction.
Figure 4B:
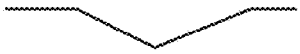
Figure 4C:
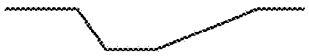
Figure 4D:
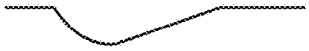
Figure 4E:
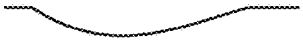
Figure 4F:
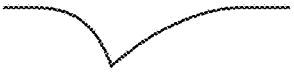
Figure 4G:
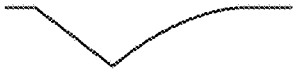
Figure 4H:
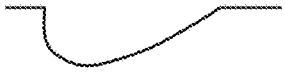

FIG. 2 illustrates an example of the opening surface of the specific concave portion and an example of the cross section thereof viewed in the circumferential direction. The example of the cross section surface of the specific concave portion illustrated in FIG. 2 represents the cross-sectional profile of the curved surface corrected to the plane.

FIGS. 3A to 3J illustrate examples of the shape of the opening of the specific concave portion (shape when the specific concave portion is viewed from above).

FIGS. 4A to 4H illustrate examples of the shape of the cross section surface of the specific concave portion when viewed in the circumferential direction.

The example of the specific concave portion illustrated in FIG. 2 will be described. First, the shape of the opening of the specific concave portion will be described. The specific concave portion has the opening surface that is an ideal surface formed when the specific concave portion is flushed. The contour of the opening of the specific concave portion illustrated in FIG. 2 has an apex (intersection point) in one of the circumferential directions of the electrophotographic photosensitive member. The apex is formed by two straight lines. The opening has a semi-circular shape in the other direction. The distances to the straight line A through the apex in the circumferential direction, from two points (at positions each indicated by the dotted line with arrows from the straight line A) decrease from a portion having the largest distance between the two lines toward the apex in the opening. The specific concave portion according to the present invention preferably has an angle of 45° or more and 90° or less, which is formed by each line connecting the end of the portion having the largest width of contour of the opening of each of the concave portions and the apex (two lines in total) and the straight line in the axial direction of the electrophotographic photosensitive member, from the viewpoint of a reduction in H/H initial streaks. The angel is more preferably 62° or more and less than 90°.

If the contour of the opening of each of the concave portions is a curved line in the present invention, a tangent is used to determine the angle formed by a curved line and a curved line or the angle formed by a curved line and a straight line with respect to the curved line.

The angle $\alpha$ is preferably more than 0° and 58° or less from the viewpoint of a reduction in the H/H initial streaks of the toner. The angle is more preferably 56° or less.

Next, the cross section surface of the specific concave portion viewed in the circumferential direction will be described.

The cross section surface of the specific concave portion viewed in the circumferential direction illustrated in FIG. 2 has, on the one hand, a shape in which the depth linearly decreases from the deepest point of each of the concave portions from the opening surface thereof in the depth direction of the electrophotographic photosensitive member toward the apex, and on the other hand a domed shape. In the present invention, the angle formed by the straight line on the opening surface of the specific concave portion and a straight line connecting the apex and the deepest point in the depth direction of the electrophotographic photosensitive member when projected from the lateral side thereof is more preferably 8.5° or less from the viewpoint of a reduction in the H/H initial streaks of the toner. Namely, the angle formed by the straight line connecting the deepest point of the specific concave portion and the apex and the opening surface of the specific concave portion is preferably 8.5° or less when the specific concave portion is viewed in the axial direction. The angle is more preferably 3.8° or less. The largest angle formed by the line connecting the deepest point of the specific concave portion and the apex and the opening surface of the specific concave portion can be 8.5° or less when the specific concave portion is viewed in the axial direction.

Examples of the shape of the opening of the specific concave portion include, for example, shapes as illustrated in FIGS. 3A to 3J. Examples of the shape of the cross section of the specific concave portion include shapes as illustrated in FIGS. 4A to 4H.

The plurality of specific concave portions provided on the circumferential surface of the electrophotographic photosensitive member all may have the same shape, opening longest diameter, and depth, or may have different shapes, opening longest diameters, and depths mixed. The concave portions may have any other shape than those listed in the present application when necessary.

To attain a more stable behavior of the cleaning blade, more preferably, specific concave portions is disposed in the same position in the circumferential direction of the electrophotographic photosensitive member while adjacent concave portions are disposed in the axial direction so as to be shifted by a length shorter than that of the specific concave portion.

The specific concave portions may be provided all over the circumferential surface of the electrophotographic photosensitive member, or may be formed on part of the circumferential surface of the electrophotographic photosensitive member. In the case where the specific concave portions are formed on part of the circumferential surface of the electrophotographic photosensitive member, the specific concave portions can be provided at least all over the contact area with the cleaning blade.

<Method for Forming Concave Portions on Circumferential Surface of Electrophotographic Photosensitive Member>

A mold having projected portions corresponding to the concave portions to be formed is pressure contacted with the circumferential surface of the electrophotographic photosensitive member to transfer the shape. Thereby, the concave portions can be formed on the circumferential surface of the electrophotographic photosensitive member.

Figure 5:
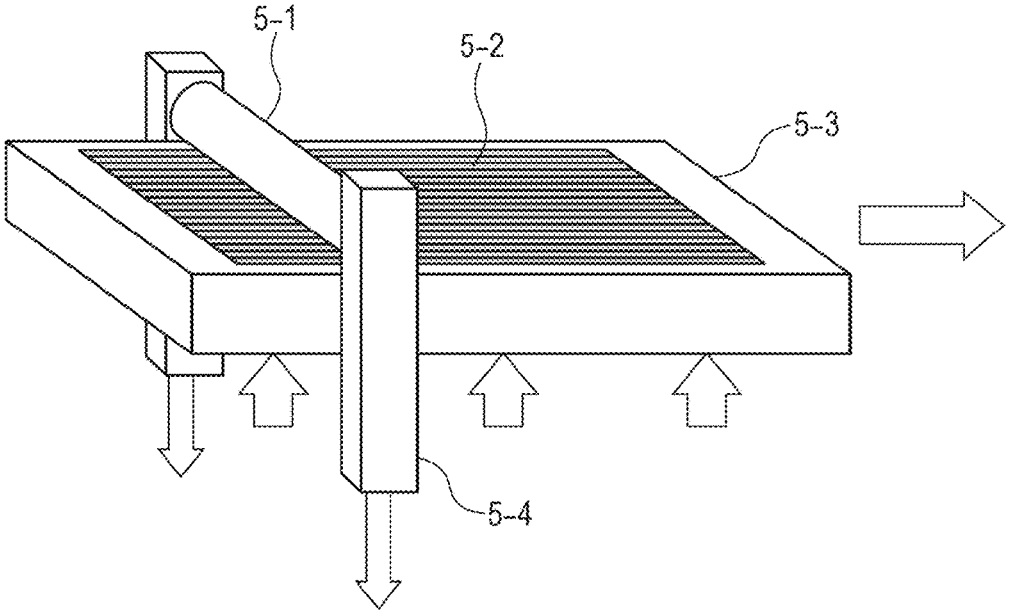
FIG. 5 is a diagram illustrating an example of an abut pressure shape transfer machine for forming concave portions on the circumferential surface of the electrophotographic photosensitive member.

FIG. 5 illustrates an example of an abut pressure shape transfer machine for forming the concave portions on the circumferential surface of the electrophotographic photosensitive member.

According to the abut pressure shape transfer machine illustrated in FIG. 5, while an electrophotographic photosensitive member 5-1 to be processed is rotated, a mold 5-2 is continuously contacted with the circumferential surface of the electrophotographic photosensitive member, and pressure is applied. Thereby, the concave portions and the flat part can be formed on the circumferential surface of the electrophotographic photosensitive member 5-1.

Examples of the material for a pressurizing member 5-3 include metals, metal oxides, plastics, and glass. Among these, preferable is stainless steel (SUS) from the viewpoint of mechanical strength, precision in size, and durability. The mold 5-2 is provided on the top surface of the pressurizing member 5-3. By a supporting member (not illustrated) and a pressurizing system (not illustrated) provided on the bottom surface side of the pressurizing member 5-3, the mold 5-2 can be contacted with the circumferential surface of the electrophotographic photosensitive member 5-1 supported by a supporting member 5-4 at a predetermined pressure. The supporting member 5-4 may also be pressed against the pressurizing member 5-3 at a predetermined pressure, or the supporting member 5-4 and the pressurizing member 5-3 may be pressed against each other.

In the example illustrated in FIG. 5, the circumferential surface of the electrophotographic photosensitive member 5-1 is continuously processed while a pressurizing member 5-3 is being moved perpendicular to the axial direction of the electrophotographic photosensitive member 5-1 so that the electrophotographic photosensitive member 5-1 is followingly rotated or drivingly rotated. Further, the pressurizing member 5-3 is fixed and the supporting member 5-4 is moved perpendicular to the axial direction of the electrophotographic photosensitive member 5-1, or both of the supporting member 5-4 and the pressurizing member 5-3 are moved. Thereby, the circumferential surface of the electrophotographic photosensitive member 5-1 can be continuously processed.

From the viewpoint of efficient shape transfer, the mold 5-2 and the electrophotographic photosensitive member 5-1 can be heated.

Examples of the mold 5-2 include those made of finely surface-processed metals and resin films, those made of a silicon wafer or the like having a surface patterned by a resist, and those made of resin films having fine particles dispersed and resin films having a fine surface shape and coated with a metal.

From the viewpoint of a uniform pressure applied to the electrophotographic photosensitive member 5-1, an elastic body can be provided between the mold 5-2 and the pressurizing member 5-3.

<Configuration of Electrophotographic Photosensitive Member>

The electrophotographic photosensitive member according to the present invention has a support and a photosensitive layer formed on the support. The electrophotographic photosensitive member has a cylindrical shape.

The photosensitive layer may be a single photosensitive layer containing a charge transport substance and a charge-generating substance in the same layer, or may be a laminated (function-separating type) photosensitive layer in which a charge generating layer containing a charge-generating substance is separated from a charge transporting layer containing a charge transport substance. From the viewpoint of electrophotographic properties, the laminated photosensitive layer is preferable. Moreover, the laminated photosensitive layer may be a normal laminate photosensitive layer in which the charge generating layer and the charge transporting layer are laminated in this order from the support side, or a reverse laminate photosensitive layer in which the charge transporting layer and the charge generating layer are laminated in this order from the support side. From the viewpoint of the electrophotographic properties, the normal laminate photosensitive layer is preferable. The charge generating layer may also have a laminated layer configuration, or the charge transporting layer may have a laminated layer configuration.

The support used for the electrophotographic photosensitive member according to the present invention can be a support showing conductivity (conductive support). Examples of a material for the support include metals (alloys) such as iron, copper, gold, silver, aluminum, zinc, titanium, lead, nickel, tin, antimony, indium, chromium, aluminum alloys, and stainless steel. Metallic supports and plastic supports having a coating film formed by vacuum evaporation using aluminum, an aluminum alloy, and an indium oxide-tin oxide alloy can also be used.

Supports obtained by impregnating a conductive particle such as carbon black, tin oxide particles, titanium oxide particles, and silver particles into a plastic or paper, and supports made of conductive binder resins can also be used.

The surface of the support may be subjected to machining, surface roughening, and alumite treatment in order to suppress interference fringes caused by scattering of laser light.

Between the support and an undercoat layer described later or the photosensitive layer (charge generating layer, charge transporting layer), a conductive layer may be provided in order to suppress interference fringes caused by scattering of laser light and coat scratches of the support.

The conductive layer used for the electrophotographic photosensitive member according to the present invention can be formed as follows: carbon black, a conductive pigment, and a resistance controlling pigment are dispersed with a binder resin to obtain a coating solution for a conductive layer, the obtained coating solution is applied, and the obtained coating film is dried. Moreover, a compound curable and polymerizable by heating, irradiation with ultraviolet rays, and irradiation with radiation may be added to the coating solution for a conductive layer.

The surface of the conductive layer formed by dispersing a conductive pigment and a resistance controlling pigment is likely to be roughened.

The film thickness of the conductive layer is preferably not less than 0.2 μm and not more than 40 μm, and more preferably not less than 1 μm and not more than 35 μm, and further more preferably not less than 5 μm and not more than 30 μm.

Examples of the binder resin used for the conductive layer include polymers of vinyl compounds such as styrene, vinyl acetate, vinyl chloride, acrylic acid esters, methacrylic acid ester, vinylidene fluoride, and trifluoroethylene, polyvinyl alcohols, polyvinyl acetals, polycarbonates, polyesters, polysulfones, polyphenylene oxide, polyurethanes, cellulose resins, phenol resins, melamine resins, silicon resins, and epoxy resins.

Examples of the conductive pigment and the resistance controlling pigment include particles of metals (alloy) such as aluminum, zinc, copper, chromium, nickel, silver, and stainless steel, and plastic particles having a surface coated with these metallic particles. Moreover, particles of metal oxides such as zinc oxide, titanium oxide, tin oxide, antimony oxide, indium oxide, bismuth oxide, tin-doped indium oxide, and antimony-doped or tantalum-doped tin oxide can be used. One of these can be used alone, or two or more thereof can be used in combination. In the case where two or more thereof is used in combination, those may be only mixed, or may be used as a solid solution or fused.

Between the support or conductive layer and photosensitive layer (charge generating layer, charge transporting layer), an undercoat layer (intermediate layer) having a barrier function or an adhesive function may be provided in order to improve adhesiveness of the photosensitive layer, applicability, and charge injecting properties from the support, and protect the photosensitive layer from electrical damage.

The undercoat layer can be formed as follows: a resin (binder resin) is dissolved in a solvent to obtain a coating solution for an undercoat layer, the obtained coating solution is applied, and the obtained coating film is dried.

Examples of the resin used for the undercoat layer include polyvinyl alcohol, poly-N-vinylimidazole, polyethylene oxide, ethyl cellulose, ethylene-acrylic acid copolymers, caseins, polyamides, N-methoxymethylated 6 nylon, copolymerized nylons, glue, and gelatin.

The film thickness of the undercoat layer is preferably not less than 0.05 μl and not more than 7 μm, and more preferably not less than 0.1 μm and not more than 2 μm.

Examples of the charge-generating substance used for the photosensitive layer include pyrylium and thiapyrylium dyes, phthalocyanine pigments having a variety of central metals and a variety of crystal forms (α, β, γ, ϵ, X type, and the like), anthanthrone pigments, dibenzpyrenequinone pigments, pyranthrone pigments, azo pigments such as monoazo, disazo, and trisazo, indigo pigments, quinacridone pigments, asymmetric quinocyanine pigments, and quinocyanine pigments. One of these charge-generating substances may be used alone, or two or more thereof may be used.

Examples of the charge transport substance used for the photosensitive layer include pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, and stilbene compounds.

In the case where the photosensitive layer is a laminated photosensitive layer, the charge generating layer can be formed as follows: the charge-generating substance is dispersed with the binder resin and a solvent, the obtained coating solution for a charge generating layer is applied, and the obtained coating film is dried. The charge generating layer may also be a deposited film of the charge-generating substance.

The ratio of the mass of the charge-generating substance to that of the binder resin can be in the range of from 1:0.3 to 1:4.

Examples of the dispersion method include methods using a homogenizer, ultrasonic dispersion, a ball mill, a vibration ball mill, a sand mill, an Attritor, and a roll mill.

The charge transporting layer can be formed as follows: the charge transport substance and the binder resin are dissolved in a solvent to obtain a coating solution for a charge transporting layer, the obtained coating solution is applied, and the obtained coating film is dried. In the case where the charge transport substance having film forming properties by itself is used, the charge transporting layer can also be formed without using the binder resin.

Examples of the binder resin used for the charge generating layer and the charge transporting layer include polymers of vinyl compounds such as styrene, vinyl acetate, vinyl chloride, acrylic acid ester, methacrylic acid ester, vinylidene fluoride, and trifluoroethylene, polyvinyl alcohols, polyvinyl acetals, polycarbonates, polyesters, polysulfones, polyphenylene oxide, polyurethanes, cellulose resins, phenol resins, melamine resins, silicon resins, and epoxy resins.

The film thickness of the charge generating layer is preferably not more than 5 μm, and more preferably from 0.1 to 2 μm.

The film thickness of the charge transporting layer is preferably from 5 to 50 μm, and more preferably from 10 to 35 μm.

From the viewpoint of improving durability of the electrophotographic photosensitive member, the surface layer of the electrophotographic photosensitive member can be formed with a crosslinked organic polymer.

In the present invention, for example, the charge transporting layer on the charge generating layer can be formed with a crosslinked organic polymer as the surface layer of the electrophotographic photosensitive member. Moreover, a surface layer formed with a crosslinked organic polymer can be formed on the charge transporting layer on the charge generating layer as a second charge transporting layer or a protective layer. The surface layer formed with a crosslinked organic polymer needs to have compatibility of film strength with the charge transport ability.

From such a viewpoint, the surface layer can be formed using a charge transport substance or a conductive particle and a crosslinked polymerizable monomer/oligomer.

As the charge transport substance, the charge transport substance described above can be used. Any known conductive particle can be used. Examples of the crosslinked polymerizable monomer/oligomer include compounds having a chain polymerizable functional group such as an acryloyloxy group and a styryl group, and compounds having a sequentially polymerizable functional group such as a hydroxy group, an alkoxysilyl group, and an isocyanate group.

From the viewpoint of the compatibility of the film strength with the charge transport ability, use of a compound having a charge transportable structure (preferably, a hole-transportable structure) and an acryloyloxy group in the same molecule is more preferable.

Examples of the method for crosslinking and curing the crosslinked polymerizable monomer/oligomer include methods using heat, ultraviolet rays, and radiation. The film thickness of the surface layer formed with the crosslinked organic polymer is preferably from 0.1 to 30 μm, and more preferably from 1 to 10 μm.

Additives can be added to the respective layers in the electrophotographic photosensitive member. Examples of the additives include deterioration preventing agents such as an antioxidant and an ultraviolet absorbing agent, organic resin particles such as fluorine atom containing resin particles and acrylic resin particles, and inorganic particles such as silica, titanium oxide, and alumina.

<Configuration of Process Cartridge and that of Electrophotographic Apparatus>

Figure 6:
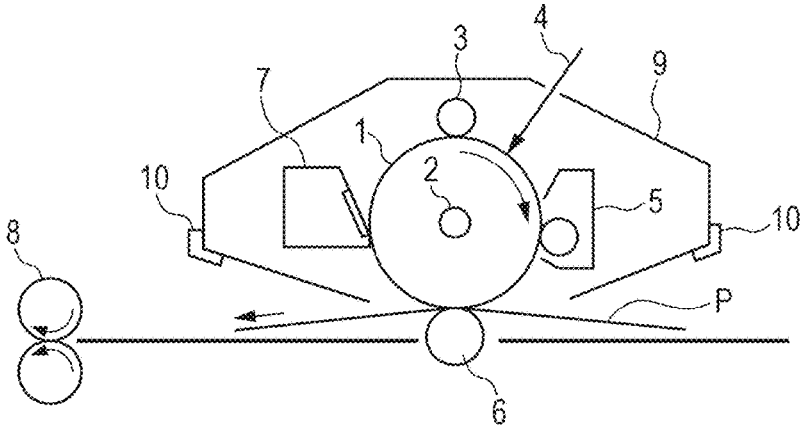
FIG. 6 is a diagram illustrating an example of an electrophotographic apparatus including a process cartridge having the electrophotographic photosensitive member according to the present invention.

FIG. 6 illustrates an example of an electrophotographic apparatus including a process cartridge having the electrophotographic photosensitive member according to the present invention.

In FIG. 6, a cylindrical electrophotographic photosensitive member 1 according to the present invention is rotated and driven around a shaft 2 in the arrow direction at a predetermined circumferential speed (process speed). The circumferential surface of the electrophotographic photosensitive member 1 is uniformly charged at a predetermined positive or negative potential by a charging unit 3 (a primary charging unit: for example, a charging roller) during rotation. Next, the uniformly charged circumferential surface of the electrophotographic photosensitive member 1 receives exposure light (image exposure light) 4 emitted from an exposure unit (image exposure unit) (not illustrated).

In this manner, an electrostatic latent image corresponding to the target image information is formed on the circumferential surface of the electrophotographic photosensitive member 1.

In the present invention, the effect is particularly remarkable in the case where a charging unit using discharging is used.

Next, the electrostatic latent image formed on the circumferential surface of the electrophotographic photosensitive member 1 is developed (normally developed or reversely developed) by a toner in a developing unit 5 (an amorphous toner or a spherical toner) to form a toner image. The toner image formed on the circumferential surface of the electrophotographic photosensitive member 1 is transferred onto a transfer material by a transfer bias from a transfer unit (for example, a transfer roller) 6. At this time, the transfer material P is taken from a transfer material feeding unit (not illustrated) and fed between the electrophotographic photosensitive member 1 and the transfer unit 6 (abut region) in synchronization with rotation of the electrophotographic photosensitive member 1. A bias voltage having polarity opposite to that of the charged toner is applied to the transfer unit from a bias power supply (not illustrated).

The transfer material P having the toner image transferred is separated from the circumferential surface of the electrophotographic photosensitive member, and conveyed to a fixing unit 8 to fix the toner image. Thereby, the transfer material P is printed out as an image forming product (print, copy) to the outside of the electrophotographic apparatus.

After transfer of the toner image, the circumferential surface of the electrophotographic photosensitive member 1 is cleaned by removing adhering products such as a transfer remaining toner by a cleaning unit 7 having a cleaning blade disposed in contact with (abutting) the circumferential surface of the electrophotographic photosensitive member 1. The cleaned circumferential surface of the electrophotographic photosensitive member 1 is discharged with pre-exposure light (not illustrated) from a pre-exposure unit (not illustrated), and then repeatedly used in formation of images. As illustrated in FIG. 6, in the case where the charging unit 3 is a contact charging unit using a charging roller or the like, the pre-exposure unit is not always needed.

In the present invention, among components selected from the electrophotographic photosensitive member 1, the charging unit 3, the developing unit 5, and the cleaning unit 7, a plurality of components may be accommodated in a container and integrally supported as a process cartridge. Then, the process cartridge can be detachably attached to the main body of the electrophotographic apparatus such as a copier and a laser beam printer. In FIG. 6, the electrophotographic photosensitive member 1, the charging unit 3, the developing unit 5, and the cleaning unit 7 are integrally supported to form a cartridge. Using a guide unit 10 such as a rail in the main body of the electrophotographic apparatus, the process cartridge 9 is detachably attached to the main body of the electrophotographic apparatus.

In the case where the electrophotographic apparatus is a copier or a printer, the exposure light 4 is the light irradiated by scanning with a laser beam or driving of an LED array or a liquid crystal shutter array, which is performed according to a signal obtained by reading reflected light or transmitted light from an original or reading an original by a sensor.

EXAMPLE

Hereinafter, using specific Examples, the present invention will be described more in detail. In Examples, "parts" means "parts by mass." The electrophotographic photosensitive member is simply referred to as a "photosensitive member" below.

(Production Example of Photosensitive Member-1)

An aluminum cylinder having a diameter of 30 mm and a length of 357.5 mm was used as the support (cylindrical support).

Next, 100 parts of a zinc oxide particle (specific surface area: 19 $m^2/g$, powder resistance: $4.7\times10^6$ Ω·cm) as a metal oxide were mixed with 500 parts of toluene by stirring. To this mixture, 0.8 parts of a silane coupling agent (compound name: N-2-(aminoethyl)-3-aminopropylmethyldimethoxysilane, trade name: KBM602, made by Shin-Etsu Chemical Co., Ltd.) were added, and the mixture was stirred for 6 hours. Subsequently, toluene was distilled off under reduced pressure. The product was dried at 130° C. for 6 hours under heating to prepare a surface treated zinc oxide particle.

Next, 15 parts of a butyral resin (trade name: BM-1, made by Sekisui Chemical Co., Ltd.) as a polyol resin and 15 parts of blocked isocyanate (trade name: Sumidur 3175, made by Sumitomo Bayer Urethane Co., Ltd.) were dissolved in a mixed solution of 73.5 parts of methyl ethyl ketone and 73.5 parts of 1-butanol. To this solution, 80.8 parts of the surface treated zinc oxide particle and 0.8 parts of 2,3,4-trihydroxybenzophenone (made by Tokyo Chemical Industry Co., Ltd.) were added, and the mixed solution was dispersed with a sand mill apparatus using glass beads having a diameter of 0.8 mm under a 23±3° C. atmosphere for 3 hours. After the dispersion, 0.01 parts of silicone oil (trade name: SH28PA, made by Dow Corning Toray Silicone Co., Ltd.) and 5.6 parts of a crosslinked poly(methyl methacrylate) (PMMA) particle (trade name: TECHPOLYMER SSX-102, made by SEKISUI PLASTICS CO., Ltd., average primary particle diameter: 2.5 μm) were added, and were stirred to prepare a coating solution for an undercoat layer.

The coating solution for an undercoat layer was applied onto the support by immersion. The obtained coating was dried at 160° C. for 40 minutes to form an undercoat layer having a film thickness of 18 μm.

Next, 20 parts of hydroxy gallium phthalocyanine crystals having strong peaks at Bragg angles of 2θ±0.2° of 7.4° and 28.2° in CuKα characteristics X ray diffraction (charge-generating substance), 0.2 parts of a calixarene compound represented by the following structural formula (A):10 parts of polyvinyl butyral (trade name: S-LEC BX-1, made by Sekisui Chemical Co., Ltd.), and 600 parts of cyclohexanone were placed in a sand mill using glass beads having a diameter of 1 mm, and dispersed for 4 hours. Then, 700 parts of ethyl acetate was added to prepare a coating solution for a charge generating layer. The coating solution for a charge generating layer was applied onto the undercoat layer by dip coating. The obtained coating film was dried for 15 minutes at 80° C. to form a charge generating layer having a film thickness of 0.17 μm.

(A)

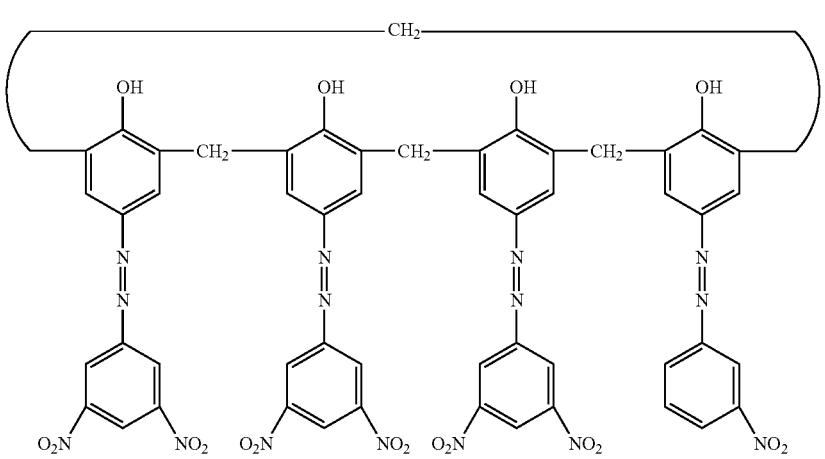

Next, 30 parts of a compound represented by the following structural formula (B) (charge transport substance), 60 parts of a compound represented by the following structural formula (C) (charge transport substance), 10 parts of a compound represented by the following structural formula (D), 100 parts of polycarbonate resin (trade name: Iupilon 2400, made by Mitsubishi Engineering-Plastics Corporation, bisphenol Z polycarbonate), and 0.02 parts of a polycarbonate having the following structural formula (E) (viscosity average molecular weight Mw: 20000) were dissolved in a mixed solvent of 600 parts of mixed xylene and 200 parts of dimethoxymethane to prepare a coating solution for a charge transporting layer. The coating solution for a charge transporting layer was applied onto the charge generating layer by immersion to form a coating. The obtained coating was dried at 100° C. for 30 minutes to form a charge transporting layer having a film thickness of 18 μm.

(B)

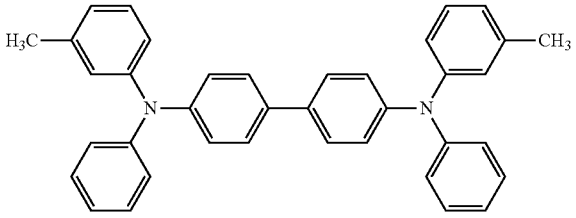

-continued (C)

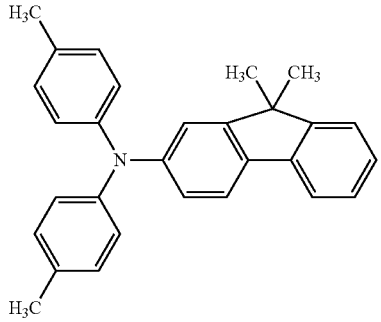

-continued (D)

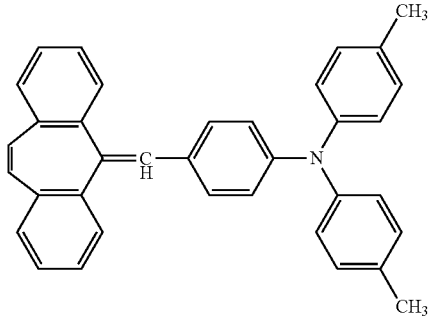

(E)

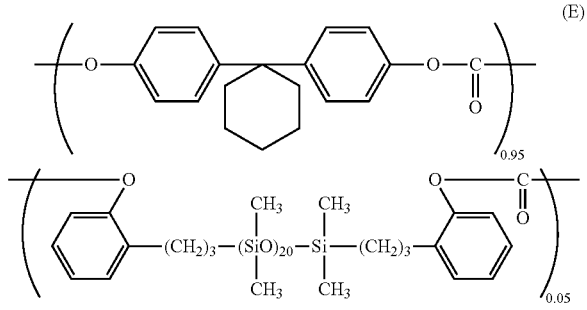

Next, 36 parts of a compound represented by the following structural formula (F) (charge transport substance having an acrylic group as a chain polymerizable functional group), 4 parts of a polytetrafluoroethylene resin fine particle (LUBURON L-2, made by DAIKIN INDUSTRIES, LTD.), and 60 parts of n-propanol were dispersed and mixed with a super high pressure dispersing machine to prepare a coating solution for a protective layer.

The coating solution for a protective layer was applied onto the charge transporting layer by immersion. The obtained coating was dried at 50° C. for 5 minutes. After the drying, while the cylinder was being rotated under a nitrogen atmosphere at an accelerating voltage of 70 kV and an absorbed dose of 8000 Gy for 1.6 seconds, the coating was irradiated with electron beams to cure the coating. Subsequently, the coating was subjected to a heat treatment under a nitrogen atmosphere for 3 minutes under a condition where the coating had a temperature of 120° C. The oxygen concentration was 20 ppm during the period from irradiation with electron beams to the heat treatment for 3 minutes. Next, the coating was subjected to a heat treatment in the air for 30 minutes under a condition where the coating had a temperature of 100° C. A protective layer (second charge transporting layer) having a film thickness of 5 μm was formed, (F)

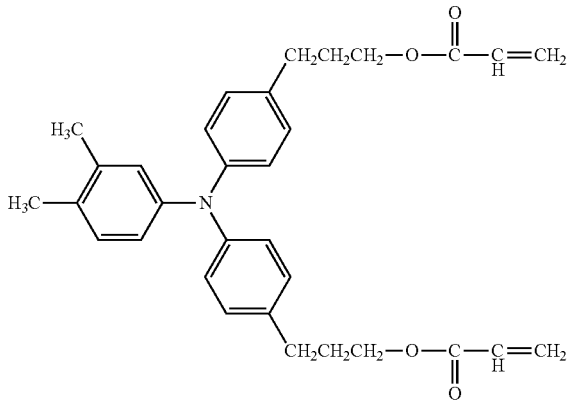

A cylindrical electrophotographic photosensitive member before formation of concave portions on the circumferential surface (electrophotographic photosensitive member before formation of concave portions) was thereby prepared.

Formation of Concave Portions by Mold abut Pressure Shape Transfer

Figure 7A:
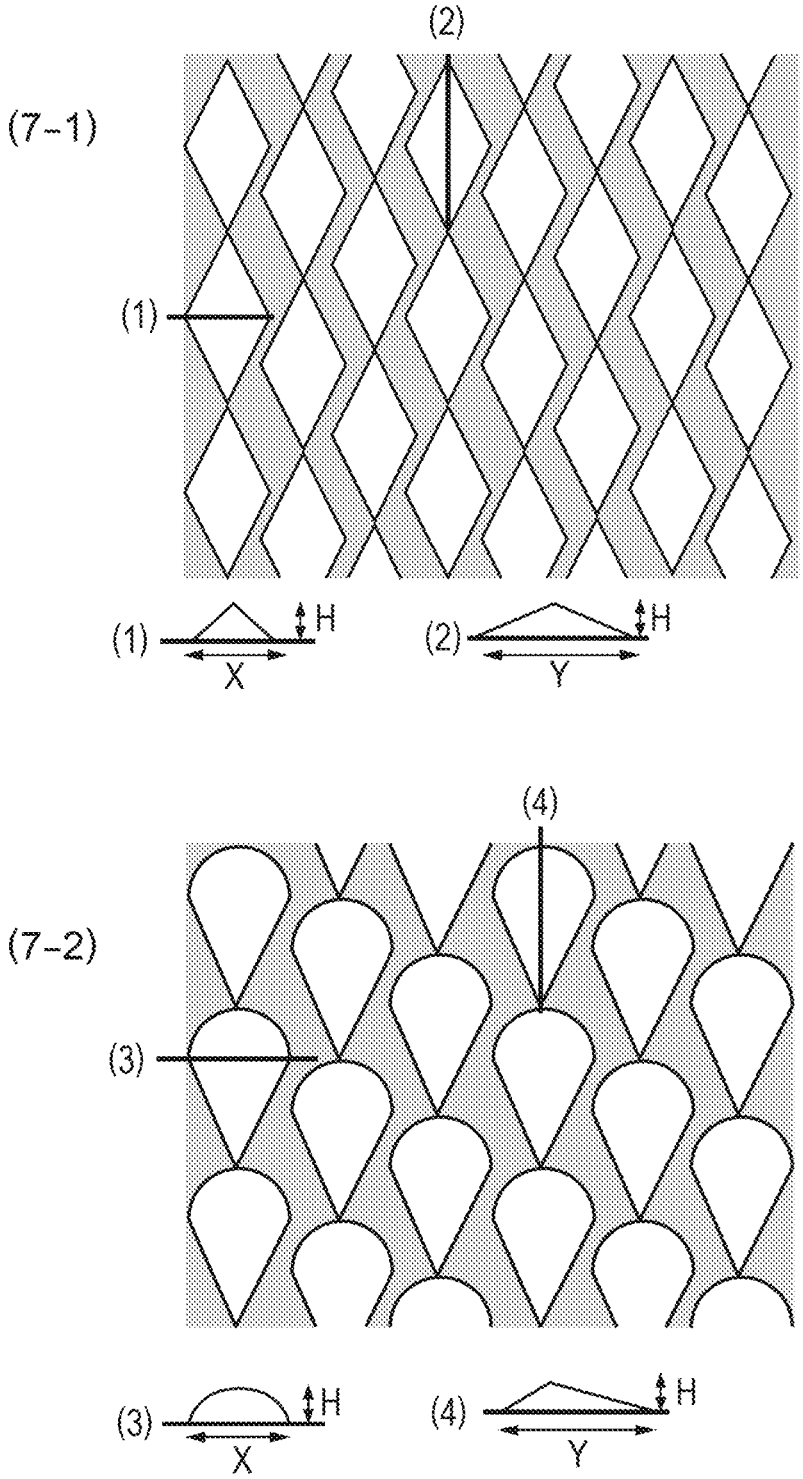
FIGS. 7A, 7B and 7C are diagrams illustrating molds used in Production Examples of electrophotographic photosensitive members.
Figure 7B:
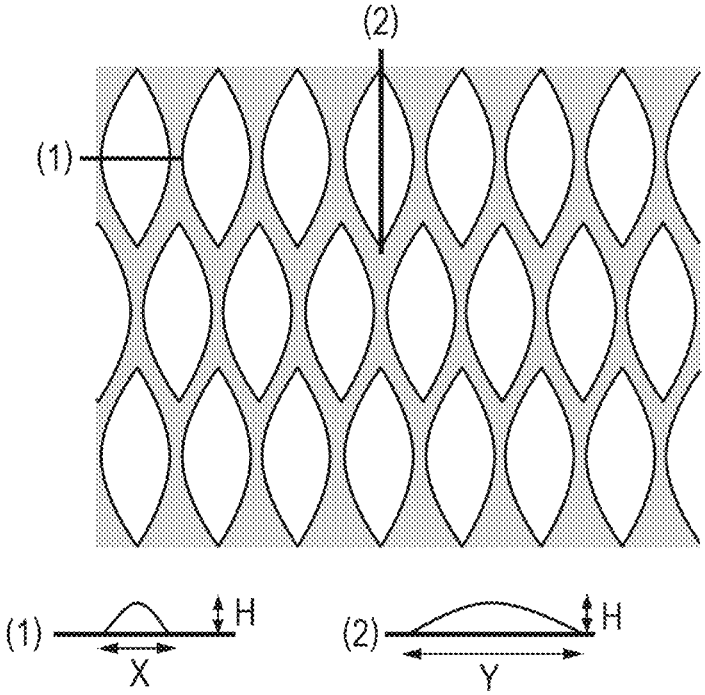
Figure 7B:
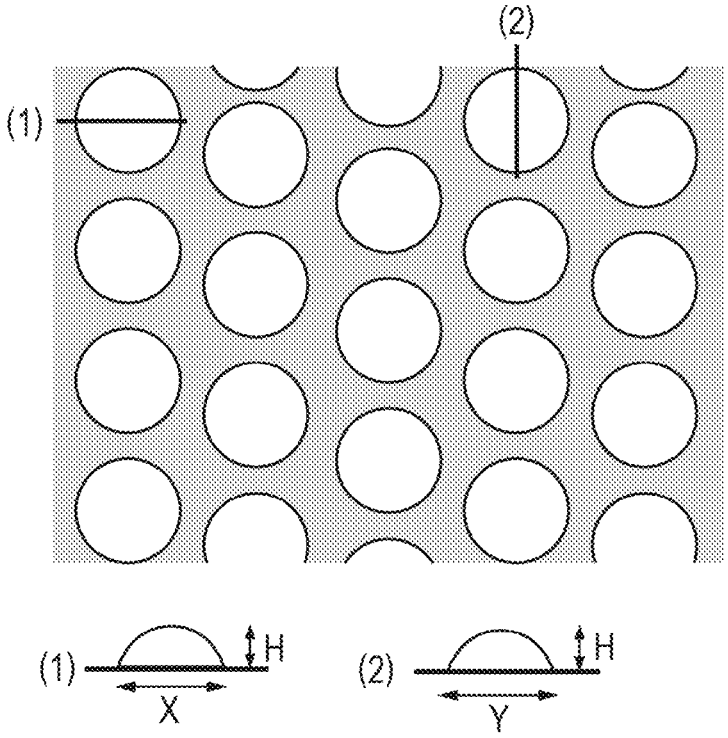
Figure 7C:
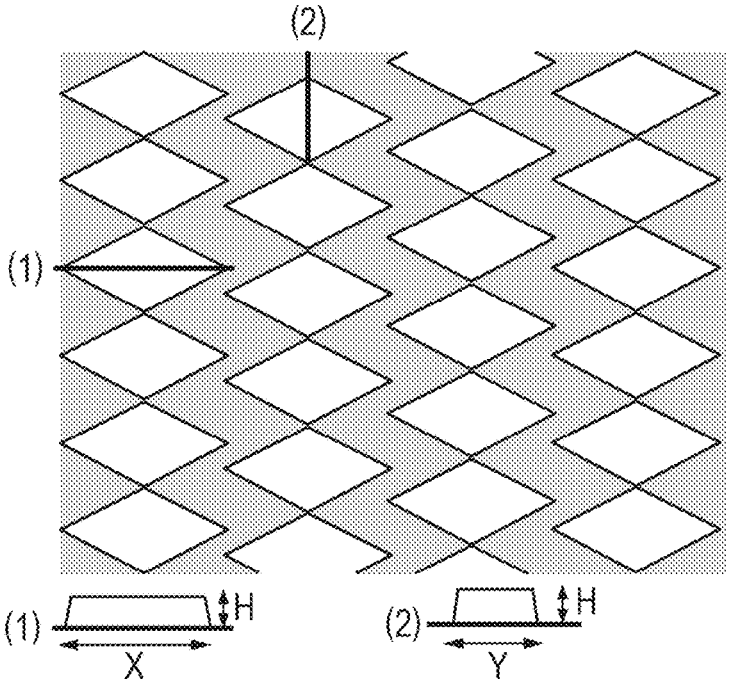
Figure 7C:
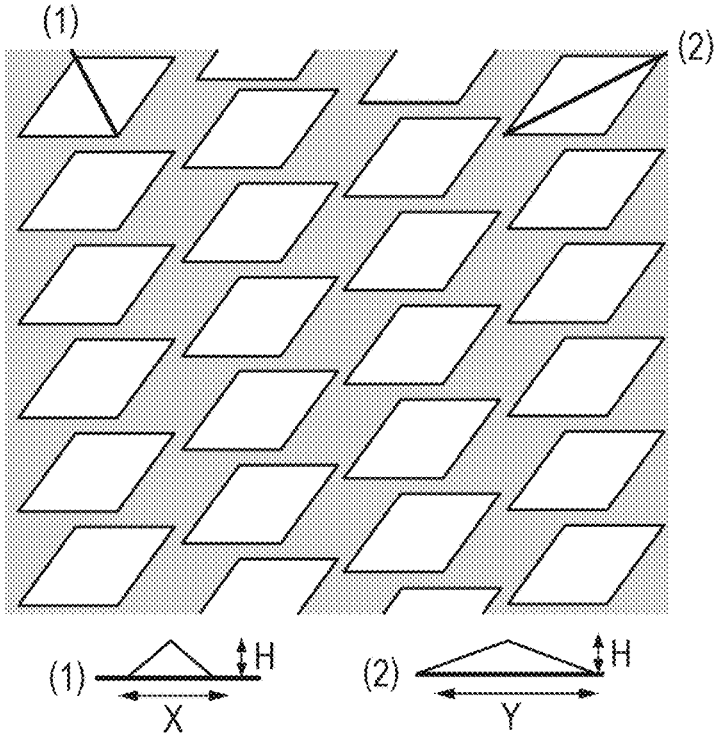

An abut pressure shape transfer machine having approximately a configuration illustrated in FIG. 5 was provided with a mold having approximately a shape illustrated in (7-1) of FIG. 7A (in this example, as shown in Table 1, the largest width of one protrusion (i.e., the largest width in the axial direction when the protrusions of the mold were viewed from above, the same is true below) X: 40 μm, the largest length thereof (i.e., the largest length in the circumferential direction when the protrusions of the mold were viewed from above, the same is true below) Y: 80 μm, area rate: 50%, height H: 4 μm). The circumferential surface of the obtained electrophotographic photosensitive member before formation of concave portions was processed with this machine. During the processing, the temperatures of the electrophotographic photosensitive member and the mold were controlled such that the temperature of the circumferential surface of the electrophotographic photosensitive member was 120° C., and while the electrophotographic photosensitive member was pressed against the pressurizing member at a pressure of 7.0 MPa, the electrophotographic photosensitive member was rotated in the circumferential direction to form the concave portions all over the circumferential surface of the electrophotographic photosensitive member.

Thus, an electrophotographic photosensitive member having the specific concave portions on the circumferential surface thereof was produced. The electrophotographic photosensitive member is referred to as "Photosensitive member-1."

Observation of Circumferential Surface of Electrophotographic Photosensitive Member The circumferential surface of the obtained electrophotographic photosensitive member (Photosensitive member-1) was magnified and observed by a laser microscope (made by Keyence Corporation, trade name: X-100) using a 50× lens, and the specific concave portions provided on the circumferential surface of the electrophotographic photosensitive member were evaluated as described above. During observation, adjustment was made such that the longitudinal direction of the electrophotographic photosensitive member was not inclined, and vertices of the arc of the electrophotographic photosensitive member were focused in the circumferential direction. The 500 μm ×500 μl square region was obtained by combining the magnified and observed images into one by an image combining application. Moreover, in the obtained results, using an attached image analyzing software, image processing height data was selected, and filtered by a filter type median.

The depth of a specific concave portion, the width of the opening in the axial direction, the length of the opening in the circumferential direction, the area, an angle at the apex formed by two straight lines, and the like were determined from the observation. The results are shown in Table 2.

The circumferential surface of the electrophotographic photosensitive member (Photosensitive member-1) was observed with a different laser microscope (made by Keyence Corporation, trade name: X-9500) by the same method. The results are the same as those from the observation with the above laser microscope (made by Keyence Corporation, trade name: X-100). In Production Examples below, the circumferential surfaces of the electrophotographic photosensitive members (Photosensitive member-2 to Photosensitive member-25 and Photosensitive member-101 to Photosensitive member-104) were observed with a laser microscope (made by Keyence Corporation, trade name: X-100) and a 50× lens.

(Production Examples of Photosensitive Member-2 to Photosensitive Member-25)

Electrophotographic photosensitive members were prepared in the same manner as in Production Example of Photosensitive member-1 except that the mold used in Production Example of Photosensitive member-1 was changed as shown in Table 1. These electrophotographic photosensitive members are referred to as "Photosensitive member-2 to Photosensitive member-25". The circumferential surfaces of the obtained electrophotographic photosensitive members were observed in the same manner as in Production Example of Photosensitive member-1. The results are shown in Table 2.

TABLE 1

| | Mold | | | | | | |
|---|---|---|---|---|---|---|---|
| | Shape of mold | Presence/absence of apex | Presence/absence of shape of cross section surface of specific concave portion decreasing from deepest point toward apex | Width in axial direction X μm | Length in circumferential direction Y μm | Area rate % | Height of mold μm |
| Photosensitive member-1 | 7-1 | Formed | Formed | 40 | 80 | 50% | 4 |
| Photosensitive member-2 | 7-1 | Formed | Formed | 40 | 80 | 40% | 4 |
| Photosensitive member-3 | 7-1 | Formed | Formed | 40 | 80 | 70% | 4 |
| Photosensitive member-4 | 7-1 | Formed | Formed | 50 | 100 | 60% | 4 |
| Photosensitive member-5 | 7-1 | Formed | Formed | 80 | 170 | 60% | 6 |
| Photosensitive member-6 | 7-1 | Formed | Formed | 20 | 40 | 40% | 6 |
| Photosensitive member-7 | 7-1 | Formed | Formed | 40 | 100 | 60% | 4 |
| Photosensitive member-8 | 7-1 | Formed | Formed | 40 | 100 | 60% | 2 |
| Photosensitive member-9 | 7-1 | Formed | Formed | 30 | 150 | 50% | 3 |
| Photosensitive member-10 | 7-1 | Formed | Formed | 50 | 90 | 60% | 6 |
| Photosensitive member-11 | 7-2 | Formed | Formed | 50 | 75 | 56% | 4 |
| Photosensitive member-12 | 7-2 | Formed | Formed | 20 | 50 | 50% | 3 |
| Photosensitive member-13 | 7-2 | Formed | Formed | 80 | 115 | 60% | 6 |
| Photosensitive member-14 | 7-2 | Formed | Formed | 40 | 75 | 40% | 4 |
| Photosensitive member-15 | 7-2 | Formed | Formed | 40 | 75 | 70% | 4 |
| Photosensitive member-16 | 7-3 | Formed | Formed | 40 | 100 | 50% | 4 |
| Photosensitive member-17 | 7-3 | Formed | Formed | 40 | 100 | 40% | 4 |
| Photosensitive member-18 | 7-3 | Formed | Formed | 40 | 100 | 70% | 4 |
| Photosensitive member-19 | 7-3 | Formed | Formed | 50 | 170 | 60% | 4 |
| Photosensitive member-20 | 7-3 | Formed | Formed | 80 | 170 | 40% | 8 |
| Photosensitive member-21 | 7-3 | Formed | Formed | 20 | 80 | 40% | 6 |
| Photosensitive member-22 | 7-3 | Formed | Formed | 40 | 120 | 60% | 4 |
| Photosensitive member-23 | 7-3 | Formed | Formed | 40 | 120 | 60% | 2 |
| Photosensitive member-24 | 7-3 | Formed | Formed | 30 | 120 | 50% | 3 |
| Photosensitive member-25 | 7-3 | Formed | Formed | 50 | 120 | 60% | 4 |

TABLE 2

| | Surface of electrophotographic photosensitive member | | | | | | | |
|---|---|---|---|---|---|---|---|---|
| | Width in axial direction X μm | Length in circumferential direction Y μm | Area $\mu m^2$ | Depth of shape μm | Angle formed by two lines extending toward apex and straight line in axial direction ° | Angle of apex ° | Angle formed by straight line connecting deepest point and apex, and opening surface ° | Largest angle formed by a line connecting deepest point and apex, and opening surface ° |
| Photosensitive member-1 | 40 | 80 | 125000 | 2 | 63 | 53 | 2.9 | 2.9 |
| Photosensitive member-2 | 40 | 80 | 100000 | 2 | 63 | 53 | 2.9 | 2.9 |
| Photosensitive member-3 | 40 | 80 | 175000 | 2 | 63 | 53 | 2.9 | 2.9 |

TABLE 2-continued

| | Surface of electrophotographic photosensitive member | | | | | | | |
|---|---|---|---|---|---|---|---|---|
| | Width in axial direction X μm | Length in circumferential direction Y μm | Area $\mu m^2$ | Depth of shape μm | Angle formed by two lines extending toward apex and straight line in axial direction ° | Angle of apex ° | Angle formed by straight line connecting deepest point and apex, and opening surface ° | Largest angle formed by a line connecting deepest point and apex, and opening surface ° |
| Photosensitive member-4 | 50 | 100 | 150000 | 2 | 63 | 53 | 2.3 | 2.3 |
| Photosensitive member-5 | 80 | 170 | 150000 | 3 | 65 | 50 | 2.0 | 2.0 |
| Photosensitive member-6 | 20 | 40 | 100000 | 3 | 63 | 53 | 8.5 | 8.5 |
| Photosensitive member-7 | 40 | 100 | 150000 | 2 | 68 | 44 | 2.3 | 2.3 |
| Photosensitive member-8 | 40 | 100 | 150000 | 1 | 68 | 44 | 1.1 | 1.1 |
| Photosensitive member-9 | 30 | 150 | 125000 | 1.5 | 79 | 22 | 1.1 | 1.1 |
| Photosensitive member-10 | 50 | 90 | 150000 | 3 | 61 | 58 | 3.8 | 3.8 |
| Photosensitive member-11 | 50 | 75 | 140000 | 2 | 63 | 53 | 2.3 | 2.3 |
| Photosensitive member-12 | 20 | 50 | 125000 | 1.5 | 76 | 28 | 2.1 | 2.1 |
| Photosensitive member-13 | 80 | 115 | 150000 | 3 | 62 | 56 | 2.3 | 2.3 |
| Photosensitive member-14 | 40 | 75 | 100000 | 2 | 70 | 40 | 2.1 | 2.1 |
| Photosensitive member-15 | 40 | 75 | 175000 | 2 | 70 | 40 | 2.1 | 2.1 |
| Photosensitive member-16 | 40 | 100 | 125000 | 2 | 65-84 | 50 | 2.3 | <8.5 |
| Photosensitive member-17 | 40 | 100 | 100000 | 2 | 65-84 | 50 | 2.3 | <8.5 |
| Photosensitive member-18 | 40 | 100 | 175000 | 2 | 65-84 | 50 | 2.3 | <8.5 |
| Photosensitive member-19 | 50 | 170 | 150000 | 2 | 69-85 | 42 | 1.3 | <8.5 |
| Photosensitive member-20 | 80 | 170 | 100000 | 4 | 61-77 | 58 | 2.7 | <8.5 |
| Photosensitive member-21 | 20 | 80 | 100000 | 3 | 70-90 | 40 | 4.3 | <8.5 |
| Photosensitive member-22 | 40 | 120 | 150000 | 2 | 68-86 | 44 | 1.9 | <8.5 |
| Photosensitive member-23 | 40 | 120 | 150000 | 1 | 68-86 | 44 | 1.0 | <8.5 |
| Photosensitive member-24 | 30 | 150 | 125000 | 1.5 | 70-90 | 40 | 1.4 | <8.5 |
| Photosensitive member-25 | 50 | 120 | 150000 | 2 | 63-80 | 54 | 1.9 | <8.5 |

(Evaluation of Electrophotographic Photosensitive Member Using Actual Machine)

Example 1

Photosensitive member-1 was mounted on a cyan station in a modified electrophotographic apparatus (copier) (trade name: iR-ADV C5255) made by Canon Inc. as an evaluation apparatus, and a test and evaluation were performed as follows.

First, under an environment of 30° C./80% RH, conditions of the charging apparatus and the image exposure apparatus were set such that the dark potential (Vd) of the electrophotographic photosensitive member was −500 V and the bright potential (Vl) was −180 V, and an initial potential of the electrophotographic photosensitive member was adjusted.

Next, setting was performed such that a cleaning blade made of a polyurethane rubber having a hardness of 77° was abutted to the circumferential surface of the electrophotographic photosensitive member at an abut angle of 28° and an abut pressure of 30 g/cm. While the heater for an electrophotographic photosensitive member (drum heater) was being turned on, 200 sheets of an evaluation chart having an A4 horizontal 1% print image were continuously output under an environment of 30° C./80% RH; then, a screen image (cyan concentration: 30%) was output as a halftone image to evaluate H/H initial streaks on the image according to the following criteria. The results are shown in Table 3.

A: the image has no streaks generated thereon.

B: the image has traces which might be streaks, but cannot be determined as streaks.

C: the image has minor streaks slightly generated thereon.

D: the image has minor streaks generated thereon.

E: the image has remarkable streaks generated thereon.

Examples 2 to 25

The electrophotographic photosensitive members were evaluated in the same manner as in Example 1 by an actual machine except that the electrophotographic photosensitive members shown in Table 3 were used. The results are shown in Table 3.

TABLE 3

| | Electrophotographic photosensitive member | Position of apex with respect to rotational direction | Results of evaluation Streaks |
|---|---|---|---|
| Example 1 | Photosensitive member-1 | Upstream side and downstream side | A |
| Example 2 | Photosensitive member-2 | Upstream side and downstream side | A |
| Example 3 | Photosensitive member-3 | Upstream side and downstream side | A |
| Example 4 | Photosensitive member-4 | Upstream side and downstream side | A |
| Example 5 | Photosensitive member-5 | Upstream side and downstream side | A |
| Example 6 | Photosensitive member-6 | Upstream side and downstream side | B |
| Example 7 | Photosensitive member-7 | Upstream side and downstream side | A |
| Example 8 | Photosensitive member-8 | Upstream side and downstream side | A |
| Example 9 | Photosensitive member-9 | Upstream side and downstream side | A |
| Example 10 | Photosensitive member-10 | Upstream side and downstream side | B |
| Example 11 | Photosensitive member-11 | Upstream side | A |
| Example 12 | Photosensitive member-12 | Upstream side | A |
| Example 13 | Photosensitive member-13 | Upstream side | A |
| Example 14 | Photosensitive member-14 | Upstream side | A |
| Example 15 | Photosensitive member-15 | Upstream side | A |
| Example 16 | Photosensitive member-16 | Upstream side and downstream side | A |

TABLE 3-continued

| | Electrophotographic photosensitive member | Position of apex with respect to rotational direction | Results of evaluation Streaks |
|---|---|---|---|
| Example 17 | Photosensitive member-17 | Upstream side and downstream side | B |
| Example 18 | Photosensitive member-18 | Upstream side and downstream side | A |
| Example 19 | Photosensitive member-19 | Upstream side and downstream side | A |
| Example 20 | Photosensitive member-20 | Upstream side and downstream side | B |
| Example 21 | Photosensitive member-21 | Upstream side and downstream side | B |
| Example 22 | Photosensitive member-22 | Upstream side and downstream side | A |
| Example 23 | Photosensitive member-23 | Upstream side and downstream side | A |
| Example 24 | Photosensitive member-24 | Upstream side and downstream side | A |
| Example 25 | Photosensitive member-25 | Upstream side and downstream side | A |

(Production Examples of Photosensitive Member-101 to Photosensitive Member-104)

Electrophotographic photosensitive members "Photosensitive member-101 to Photosensitive member-104" were prepared in the same manner as in Production Example of Photosensitive member-1 except that the mold used in Production Example of Photosensitive member-1 was changed as shown in Table 4. The circumferential surfaces of the obtained electrophotographic photosensitive members were observed in the same manner as in Production Example of Photosensitive member-1. The results are shown in Table 5.

TABLE 4

| | Mold | | | | | | |
|---|---|---|---|---|---|---|---|
| | Shape of mold | Presence/absence of Apex | Presence/absence of shape of concave portion decreasing from deepest point toward apex | Width in axial direction X μm | Length in circumferential direction Y μm | Area rate % | Height of mold μm |
| Photosensitive member-101 | 7-4 | Not formed | | 50 | 50 | 70% | 4 |
| Photosensitive member-102 | 7-4 | Not formed | | 50 | 50 | 40% | 4 |
| Photosensitive member-103 | 7-5 | Formed | Not formed | 80 | 40 | 50% | 3 |
| Photosensitive member-104 | 7-6 | Not formed | | 40 | 80 | 50% | 6 |

TABLE 5

| | Circumferential surface of electrophotographic photosensitive member | | | | | |
|---|---|---|---|---|---|---|
| | Width in axial direction X μm | Length in circumferential direction Y μm | Area $\mu m^2$ | Depth of concave portion μm | Angle α ° | Angle formed by straight line connecting deepest point and apex and opening surface ° |
| Photosensitive member-101 | 50 | 50 | 175000 | 2 | | |
| Photosensitive member-102 | 50 | 50 | 100000 | 2 | | |
| Photosensitive member-103 | 80 | 40 | 125000 | 1.5 | 127 | |

TABLE 5-continued

| | Circumferential surface of electrophotographic photosensitive member | | | | | |
|---|---|---|---|---|---|---|
| | Width in axial direction X μm | Length in circumferential direction Y μm | Area $\mu m^2$ | Depth of concave portion μm | Angle α ° | Angle formed by straight line connecting deepest point and apex and opening surface ° |
| Photosensitive member-104 | 40 | 80 | 125000 | 3 | | |

Comparative Examples 1 to 5

The electrophotographic photosensitive members were evaluated in the same manner as in Example 1 by an actual machine except that the electrophotographic photosensitive members shown in Table 6 were used. The results are shown in Table 6.

TABLE 6

| | Electrophotographic photosensitive member | Position of apex with respect to rotational direction | Results of evaluation Streaks |
|---|---|---|---|
| Comparative Example 1 | Photosensitive member-101 | Not found | E |
| Comparative Example 2 | Photosensitive member-102 | Not found | E |
| Comparative Example 3 | Photosensitive member-103 | Upstream side and downstream side | E |
| Comparative Example 4 | Photosensitive member-104 | Not found | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a National Phase of PCT/JP2015/078418 filed Sep. 30, 2015, which in turn claims the benefit of Japanese Patent Application No. 2014-202265, filed Sep. 30, 2014, which are hereby incorporated by reference herein in their entirety.

The invention claimed is:

1. A cylindrical electrophotographic photosensitive member to be rotatably driven in an electrophotographic apparatus, wherein, a circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

2. The electrophotographic photosensitive member according to claim 1, wherein an area of an opening surfaces of the concave portions in a square region having a side of 500 μm is 100000 $\mu m^2$ or more when the square region having a side of 500 μm is disposed in any position of the circumferential surface of the electrophotographic photosensitive member, the opening surface being an ideal surface formed when each of the concave portions is flushed.

3. The electrophotographic photosensitive member according to claim 1, wherein when each of the concave portions is viewed in the axial direction, an angle formed by a straight line connecting the deepest point and the apex in the contour and an opening surface is 8.5° or less, the opening surface being an ideal surface formed when each of the concave portions is flushed.

4. The electrophotographic photosensitive member according to claim 1, wherein when each of the concave portions is viewed in the axial direction, a largest angle formed by a line connecting the deepest point and the apex in the contour and an opening surface is 8.5° or less, the opening surface being an ideal surface formed when each of the concave portions is flushed.

5. The electrophotographic photosensitive member according to claim 1, wherein the angle α is more than 0° and 58° or less.

6. A cylindrical electrophotographic photosensitive member, wherein, a circumferential surface of the electrophotographic photosensitive member has concave portions that are independent one another, each of the concave portions has an opening, a contour of the opening has an apex having an angle α of more than 0° and 90° or less on at least one of circumferential directions of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

7. The electrophotographic photosensitive member according to claim 6, wherein an area of an opening surfaces of the concave portions in a square region having a side of 500 μm is 100000 $\mu m^2$ or more when the square region having a side of 500 μm is disposed in any position of the circumferential surface of the electrophotographic photosensitive member, the opening surface being an ideal surface formed when each of the concave portions is flushed.

8. The electrophotographic photosensitive member according to claim 6, wherein when each of the concave portions is viewed in the axial direction, an angle formed by a straight line connecting the deepest point and the apex in the contour and an opening surface is 8.5° or less, the opening surface being an ideal surface formed when each of the concave portions is flushed.

9. The electrophotographic photosensitive member according to claim 6, wherein when each of the concave portions is viewed in the axial direction, a largest angle formed by a line connecting the deepest point and the apex in the contour and an opening surface is 8.5° or less, the opening surface being an ideal surface formed when each of the concave portion is flushed.

10. The electrophotographic photosensitive member according to claim 6, wherein the angle α is more than 0° and 58° or less.

11. A process cartridge to be detachably attached to a main body of an electrophotographic apparatus, wherein, the process cartridge comprises:

a cylindrical electrophotographic photosensitive member to be rotatably driven in the electrophotographic apparatus, and a cleaning blade disposed in contact with a circumferential surface of the electrophotographic photosensitive member, and wherein, the circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

12. The process cartridge according to claim 11, wherein an area of an opening surfaces of the concave portions in a square region having a side of 500 μm is 100000 $\mu m^2$ or more when the square region having a side of 500 μm is disposed in any position of a contact area between the circumferential surface of the electrophotographic photosensitive member and the cleaning blade, the opening surface being an ideal surface formed when each of the concave portions is flushed.

13. The process cartridge according to claim 11, wherein when each of the concave portions is viewed in the axial direction, an angle formed by a straight line connecting the deepest point and the apex in the contour and an opening surface is 8.5° or less, the opening surface being an ideal surface formed when each of the concave portions is flushed.

14. The process cartridge according to claim 11, wherein when each of the concave portions is viewed in the axial direction, a largest angle formed by a line connecting the deepest point and the apex in the contour and an opening surface is 8.5° or less, the opening surface being an ideal surface formed when each of the concave portions is flushed.

15. The process cartridge according to claim 11, wherein the angle α is more than 0° and 58° or less.

16. An electrophotographic apparatus comprising:

a cylindrical electrophotographic photosensitive member to be rotatably driven in the electrophotographic apparatus, and a cleaning blade disposed in contact with a circumferential surface of the electrophotographic photosensitive member, wherein, the circumferential surface of the electrophotographic photosensitive member has concave portions that are independent one another, each of the concave portions has an opening, a contour of the opening has an apex having an angle α of more than 0° and 90° or less on at least an upstream side of a rotational direction of the electrophotographic photosensitive member, and has a largest width in an axial direction of the electrophotographic photosensitive member of 20 μm or more and 80 μm or less, a width of the contour in the axial direction of the electrophotographic photosensitive member decreasing from a portion having the largest width toward the apex, and wherein, when viewing each of the concave portions in the axial direction, each of the concave portions has a depth that decreases from a deepest point of each of the concave portions toward the apex.

17. The electrophotographic apparatus according to claim 16, wherein an area of an opening surfaces of the concave portions in a square region having a side of 500 μm is 100000 $\mu m^2$ or more when the square region having a side of 500 μm is disposed in any position of a contact area between the circumferential surface of the electrophotographic photosensitive member and the cleaning blade, the opening surface being an ideal surface formed when each of the concave portions is flushed.

18. The electrophotographic apparatus according to claim 16, wherein when each of the concave portions is viewed in the axial direction, an angle formed by a straight line connecting the deepest point and the apex in the contour and an opening surface is 8.5° or less, the opening surface being an ideal surface formed when each of the concave portions is flushed.

19. The electrophotographic apparatus according to claim 16, wherein when each of the concave portion is viewed in the axial direction, a largest angle formed by a line connecting the deepest point and the apex in the contour and an opening surface is 8.5° or less, the opening surface being an ideal surface formed when each of the concave portion is flushed.

20. The electrophotographic apparatus according to claim 16, wherein the angle α is more than 0° and 58° or less.

* * * * *